US005566852A

United States Patent [19]

Emery

[11] Patent Number: 5,566,852

[45] **Date of Patent: * Oct. 22, 1996**

[54] CARRY OUT TRAY WITH FIXED PANEL

[76] Inventor: Roy W. Emery, 1 Donino Court, Toronto, Ontario, Canada, M4H 2H6

[ * ] Notice: The portion of the term of this patent subsequent to Jul. 27, 2013, has been disclaimed.

[21] Appl. No.: 448,183

[22] Filed: May 23, 1995

[51] Int. Cl.[6] ..... B65D 1/36

[52] U.S. Cl. ..... 220/556; 220/507; 220/738; 220/575; 229/904

[58] Field of Search ..... 229/904; 220/575, 220/5, 556, 507, 738; 206/564, 557

[56] References Cited

U.S. PATENT DOCUMENTS 2,766,919 10/1956 Randall ..... 229/904
3,638,849 2/1972 Goings ..... 229/904
5,096,065 3/1992 Vigue ..... 229/904
5,205,474 4/1993 Stuart et al. ..... 229/904
5,316,173 5/1994 Emery .

*Primary Examiner*—Joseph M. Moy
*Attorney, Agent, or Firm*—Marshall, O'Toole, Gerstein, Murray & Borun

[57] ABSTRACT

Trays for carrying out beverage cups having at least one cell to support upright at least one cup in each cell, each of said cells having one fixed side wall and one opposing pressure side wall, said pressure side wall being directed downwardly and inwardly of the cell, and free at its lower end to be flexed outwardly by the entry of a cup or cups, said pressure side wall having convoluted areas between downwardly and inwardly directed ribs in order to provide lateral support between two of said ribs for each of said at least one cup, and to provide lateral flexibility across the width of said pressure wall.

4 Claims, 5 Drawing Sheets

CARRY OUT TRAY WITH FIXED PANEL

FIELD OF THE INVENTION

This invention relates to carry out trays. In particular it relates to carry out trays having at least one cell for receiving and holding upright therein at least one beverage cup.

BRIEF DESCRIPTION OF THE PRIOR ART

A known tray may have a cell with one, two, three or four pressure panels spaced around the perimeter of the cell, which panels are resiliently displaced outwardly of the centre of the cell when a cup is placed therebetween. Cups of a limited range of sizes can be received within such a cell and supported in an upright position therein. A carry out tray described in U.S. Pat. No. 5,316,173 relies on only two pressure side walls.

In all of the known carry out trays as described above, each of the cup receiving cells is designed to receive only one cup.

SUMMARY OF THE INVENTION

According to this invention a carry out tray has at least one cell wherein to support at least one cup in each of said at least one cell, each of said cells having a vertical axis and being comprised of a top rim, a first side wall and a second side wall, two end walls and a supporting bottom panel, said two side walls and two end walls being joined to each other at their adjacent edges to form the circumference of said cell, each of said two side walls and two end walls being connected at their top edges to said top rim, and each of said first side wall and said two end walls being connected at their bottom edges to said bottom panel, thereby to form a supporting structure for said cell, and to provide a secure position for supporting said tray between the thumb and fingers of one hand. Said second side wall is free of connection to said bottom panel, leaving it free to flex outwardly of said cell with the entry of one or two cups.

Each of said two side walls is formed with at least two ribs directed downwardly and inwardly of said cell, the top edges of said two side walls and their related ribs being spaced sufficiently far apart to receive said cup, and said second side wall being projected inwardly at its bottom edge a predetermined distance into the area to be occupied by said cup, said lower edge of said second side wall being displaced and flexed outwardly of said cell, thereby providing a supporting pressure on said cup between said first side wall and said second side wall, with four points of lateral support and contact at two of said ribs of each of said side walls.

The areas between the ribs of said second side wall, and between the end ribs of said side wall and the adjacent end wall, are tapered from a linear connection at their top edges to said top rim to a partially cylindrical form at their bottom edges, thereby to provide both lateral and outward flexibility in said second side wall in order to accommodate the containment of said at least one cup.

Where each of said first side wall and said second side wall is formed with at least four equally spaced ribs, a single cup may be accommodated between any two adjacent ribs of said first side wall and the directly opposing two ribs of said second side wall. Where said cell with four of said equally spaced ribs on each of said two side walls is to receive two cups, each of said cups will be located between two ribs of each of said side walls located at one end or the other of said cell in order to accommodate the larger diameters of the top rims of said cups.

BRIEF DESCRIPTION OF THE DRAWINGS

FIG. 5 is a plan view of a carry out tray comprised of one cup receiving cell and a pan to carry sandwiches or the like.

DESCRIPTION OF PREFERRED EMBODIMENTS

Figure 1:
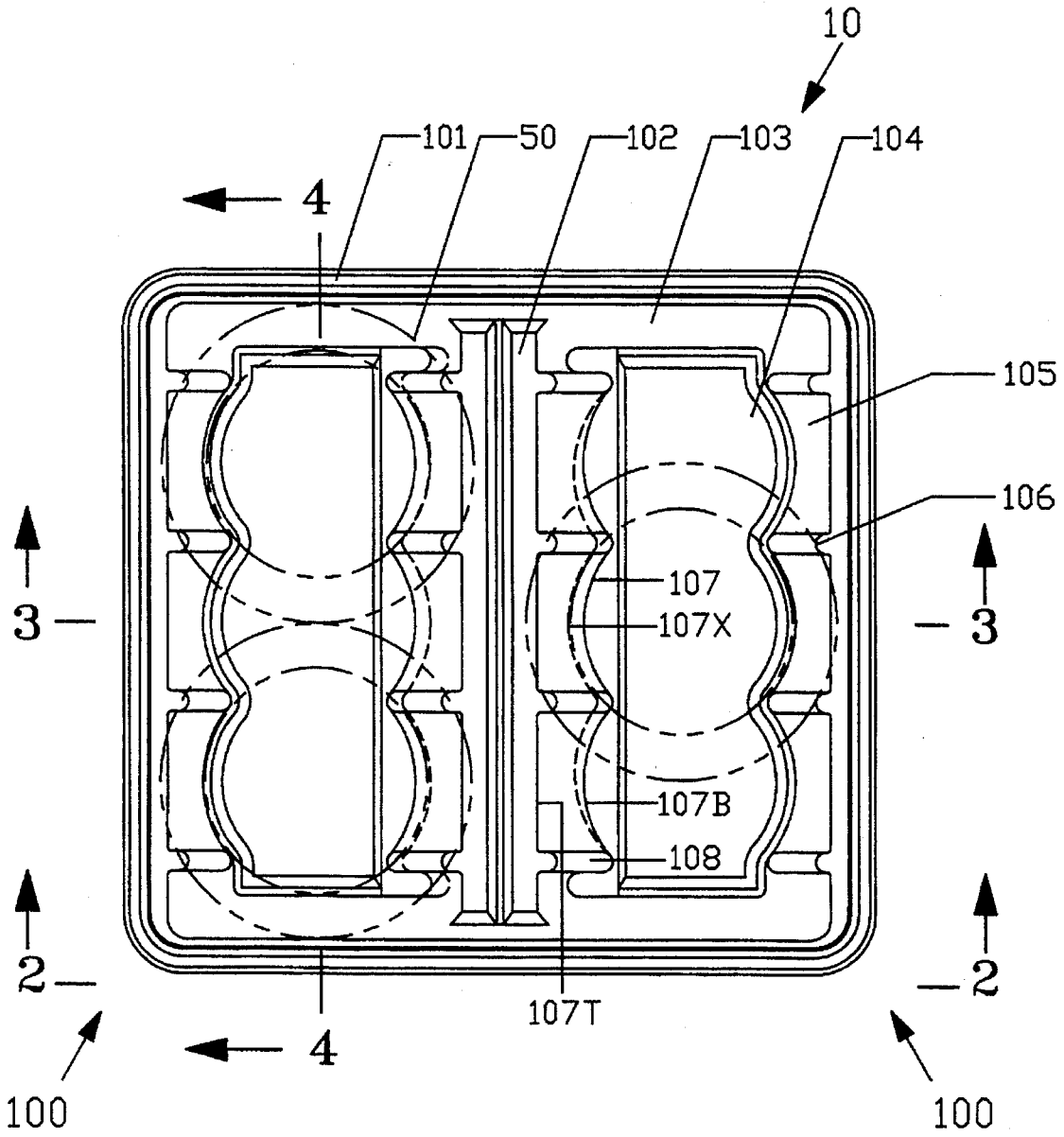
FIG. 1 is a plan view of a carry out tray comprised of two integrally connected cells, each cell being capable of receiving and supporting either one or two beverage cups.
Figure 2:
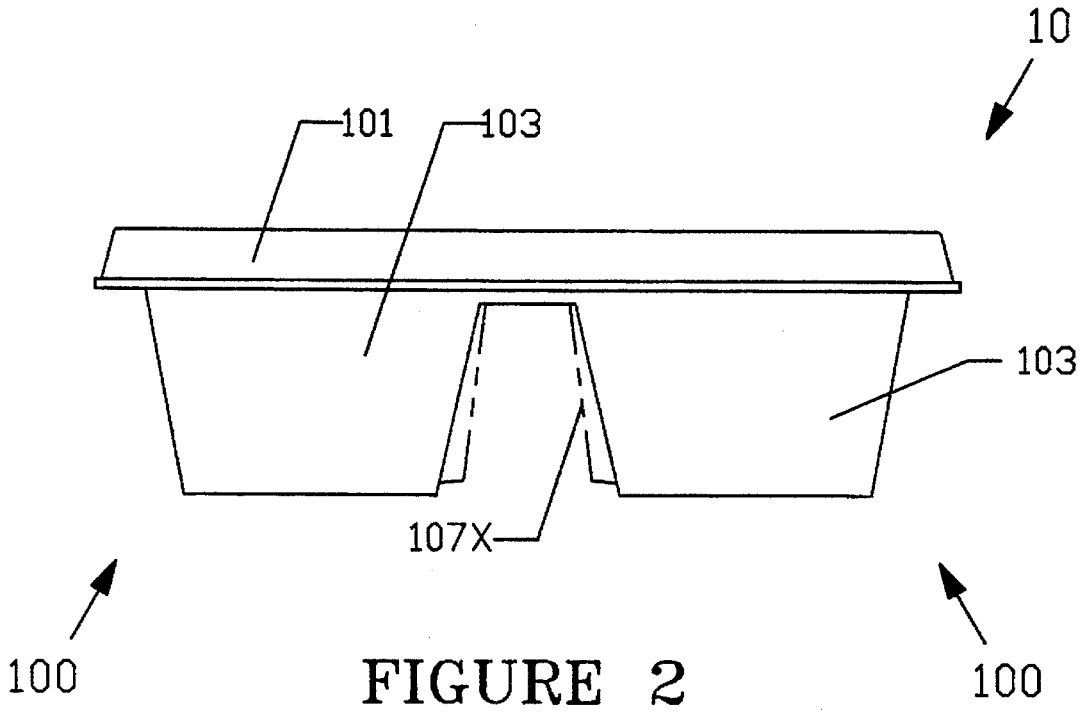
FIG. 2 is an end elevation of said two cells viewed from line 2—2 of FIG. 1.
Figure 3:
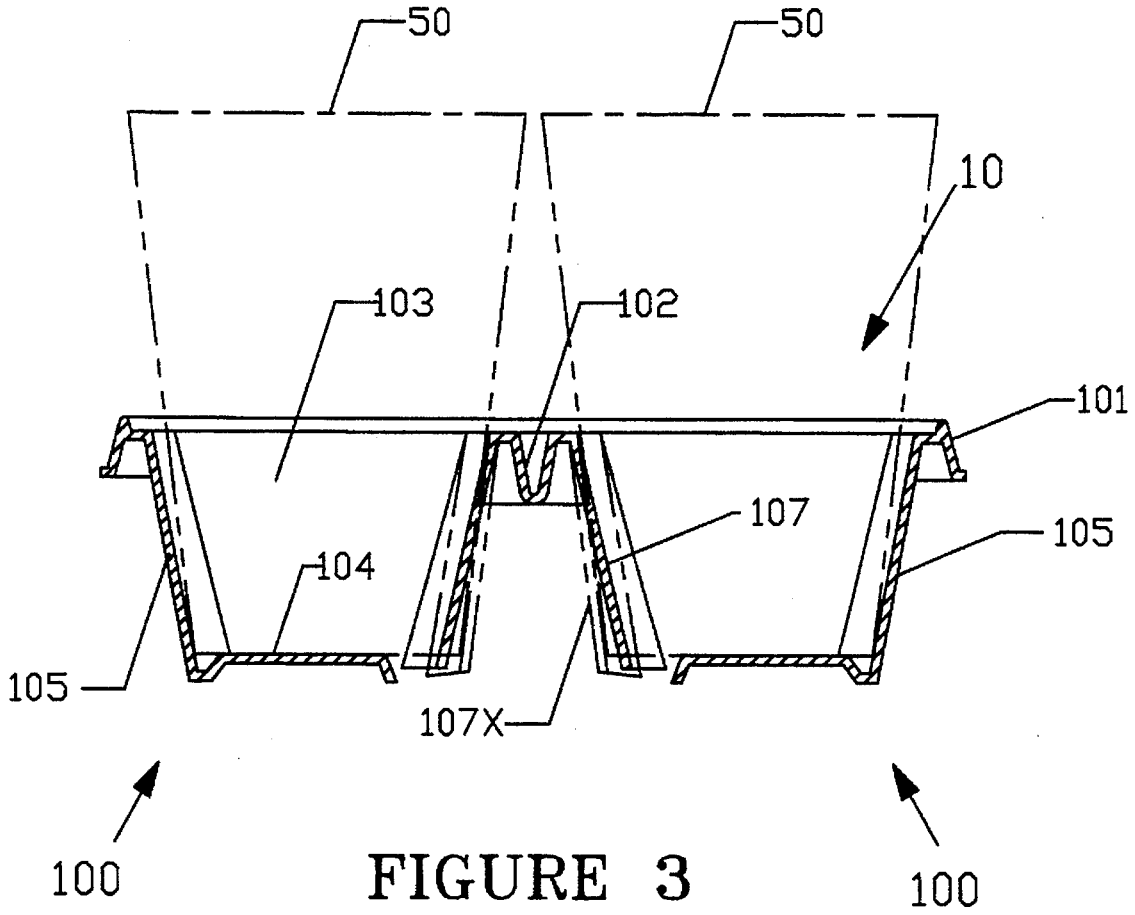
FIG. 3 is a cross sectional view of said two cells at line 3—3 of FIG. 1.
Figure 4:
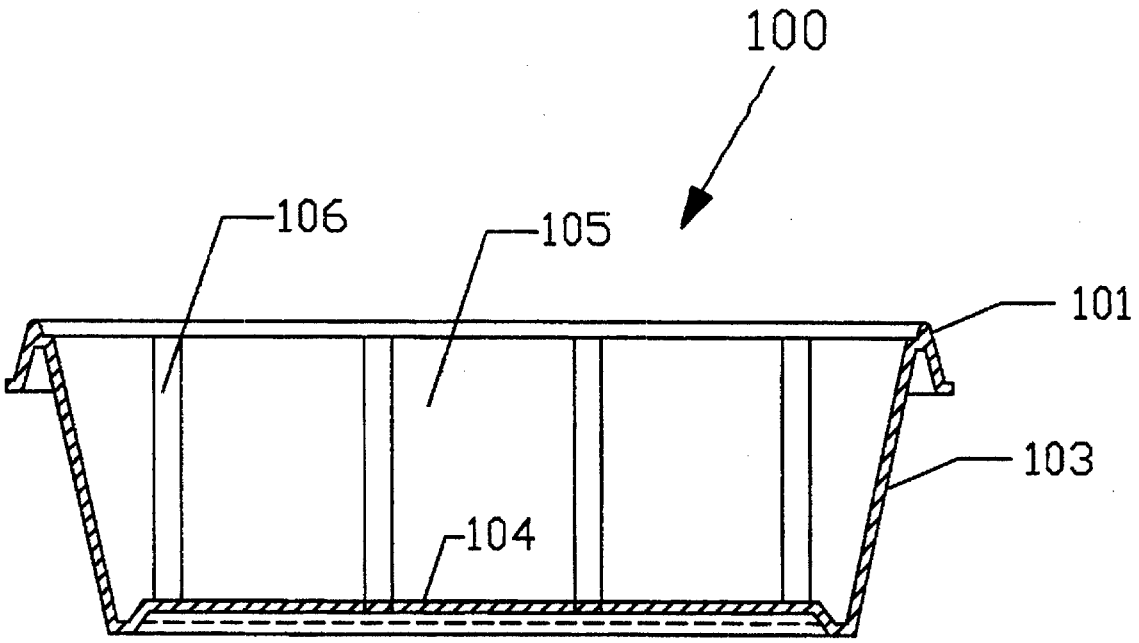
FIG. 4 is a cross sectional view of one of said two cells at line 4—4 of FIG. 1, showing the inner face of a fixed side wall.

The carry out tray 10 shown in FIG. 1, FIG. 2, FIG. 3 and FIG. 4 is fabricated of a resilient material such as polystyrene or moulded pulp fibre and is comprised of two cup receiving cells 100, integrally connected together by a surrounding rim 101 and a central supporting bar 102. Each of said cells 100 is comprised of a portion of said rim 101, a first side wall 105, a second side wall 107, two end walls 103, and a bottom panel 104, said second side walls 107 being supported one on each side of said central bar 102. In each of said cells 100 said first side wall 105, said second side wall 107, and said two end walls 103 are connected together in series at their adjacent edges to form the circumference of said cell 100, and said first side wall 105 and said two end walls 103 are each connected at their top edges to said rim 101 and at their bottom edges to said bottom panel 104 to form together the principal structure of said carry out tray 10. In each of said cells 100, said second side wall 107 is connected at its top edge to one side or the other of said central bar 102, but each of said second side walls 107 is free of connection to said bottom panel, thereby leaving it free to flex outwardly of said cell 100 when displaced by the entry of one or two cups 50. Said first side wall 105 is formed with four parallel ribs 106, and said second side wall 107 is formed with four parallel ribs 108, and each of said ribs is directed downwardly and inwardly of said cell 100. Said second side wall 107, as formed, is directed inwardly a predetermined distance at its bottom edge into the area to be occupied by an entering cup 50, thereby to produce a flexing action to position 107X with the entry of said cup 50, and provide a stabilizing pressure on said cup 50 between said first sidewall 105 and said second side wall 107.

Along each of said second side walls 107 said four parallel ribs 108 are equally spaced apart a predetermined distance to receive one cup 50 between any two adjacent ribs 108, the area of said second side walls 107 between adjacent ribs 108 and between said ribs 108 and said end walls 103 being convoluted outwardly of said cells 100 thereby to provide both lateral and outward flexibility to accommodate the entry of a cup or cups of a predetermined range of shapes and sizes. More particularly, the areas between the ribs of the second side wall 107, and between each of the two endmost ribs of the second side wall and the adjacent edge of an end wall 103 are tapered from a linear connection to the top rim 101 at their respective top edges 107T to a part cylindrical form at each of their bottom edges 107B. As shown in FIG. 1, each of said cells 100 has the capacity to accommodate either one single cup 50, or two cups 50, when so required.

Figure 5:
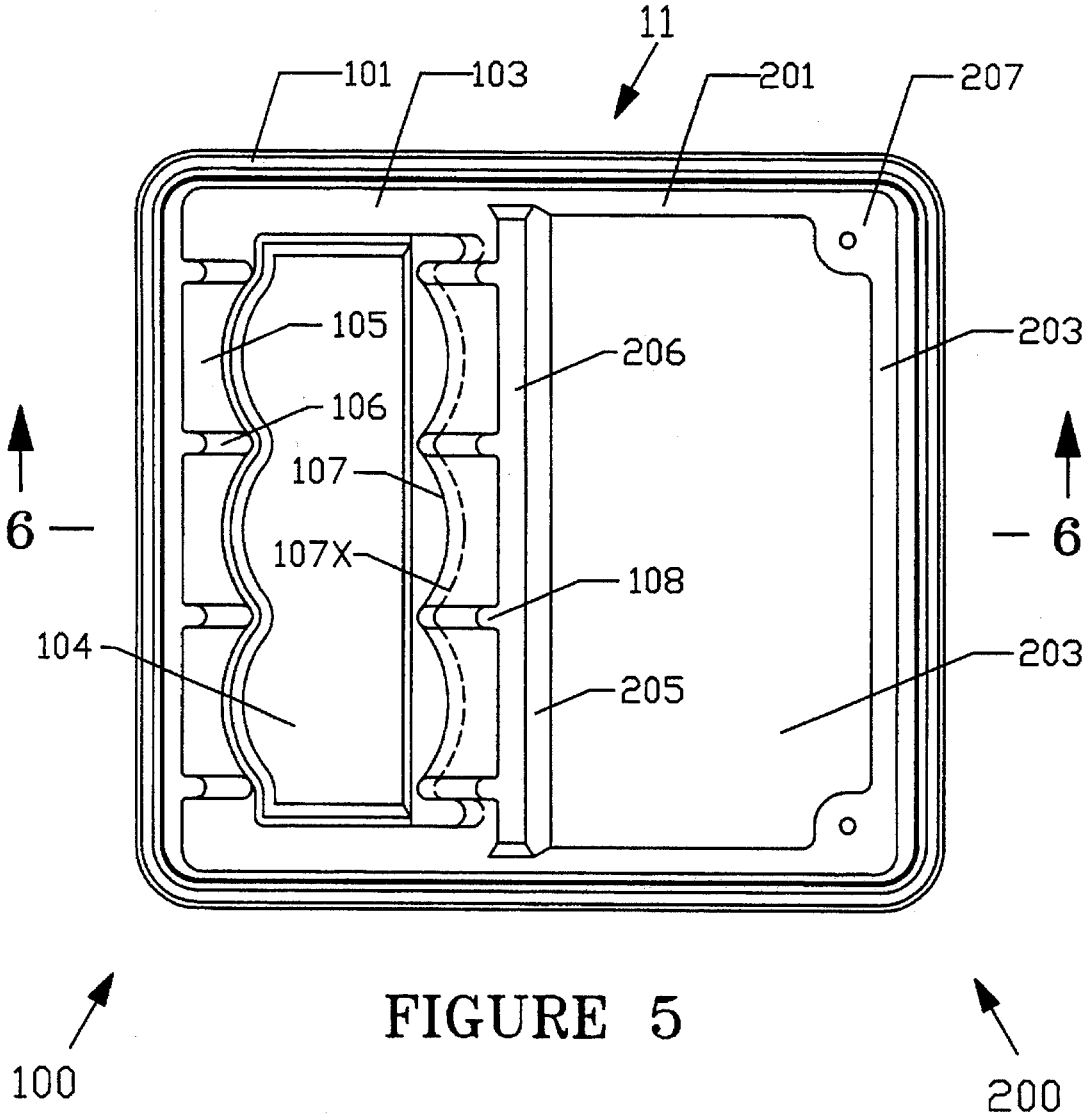
Figure 6:
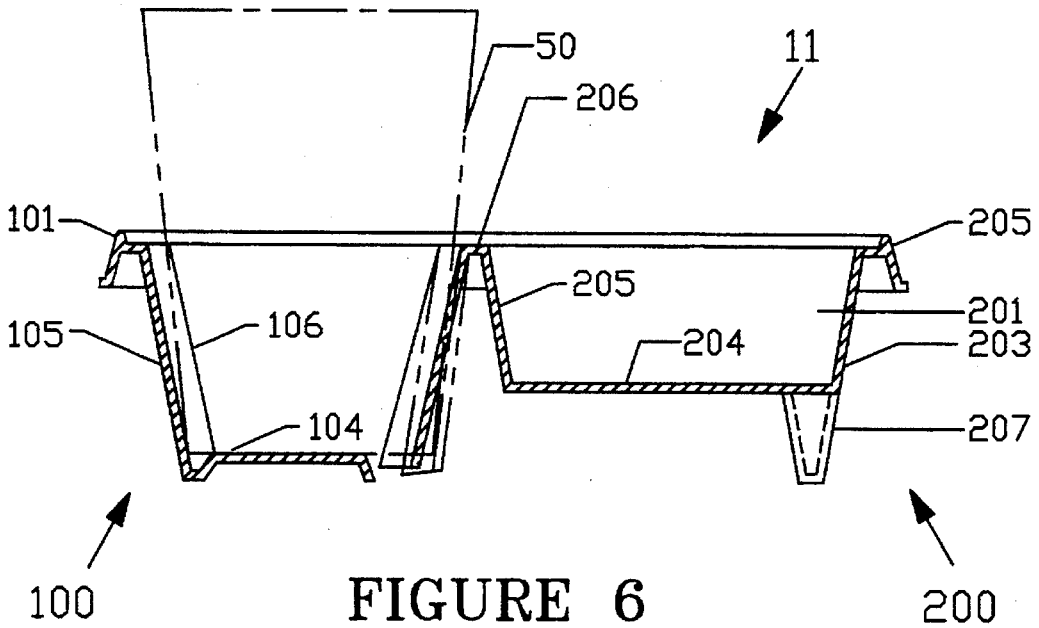
FIG. 6 is a cross sectional view of said carry out tray at line 6—6 of FIG. 5.

The carry out tray 11 shown in FIG. 5 and FIG. 6 is comprised of one cup receiving cell 100 and one sandwich receiving pan 200, integrally connected together by the surrounding top rim 101 and the central supporting bar 206. The side wall 205 of pan 200 is connected to one side of said control bar 204 and forms a part thereof, and the second side wall 107 of said cell 100 is connected to the other side of said central bar 204 and forms another part thereof. The conical legs 207 support the outer side of said pan 200 when said tray is placed upon a table or other horizontal surface.

Figure 7:
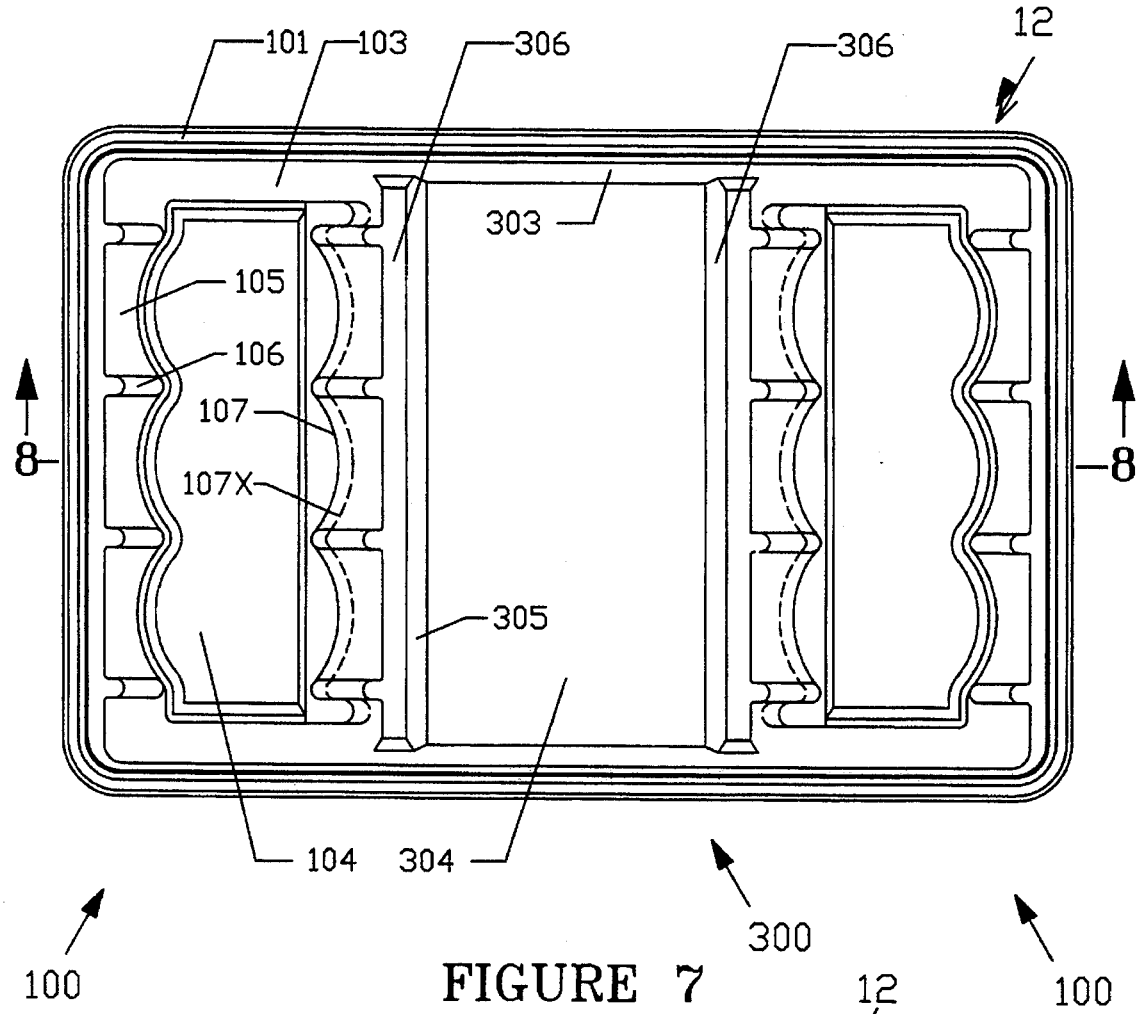
FIG. 7 is a plan view of a carry out tray comprised of two cup receiving cells integrally connected with a sandwich pan therebetween.
Figure 8:
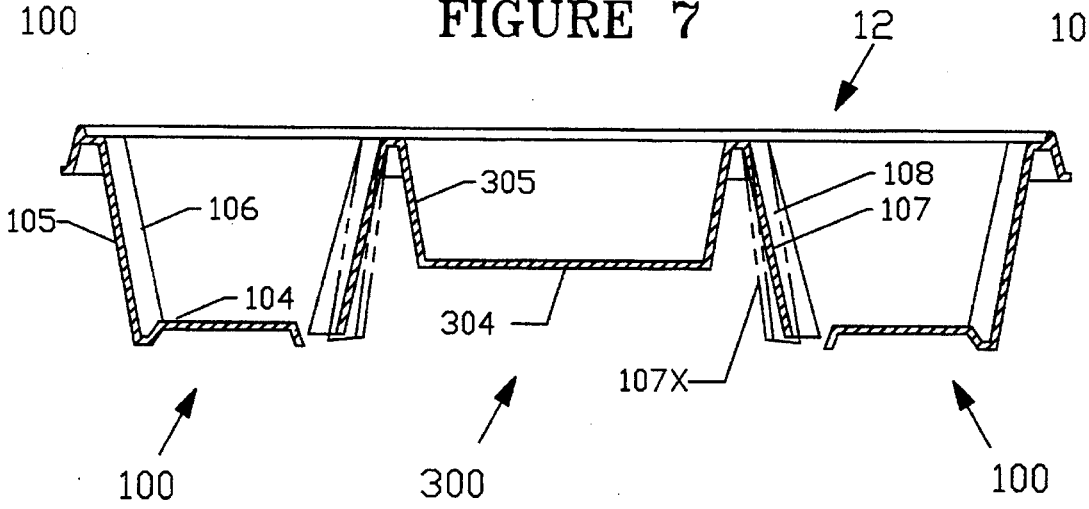
FIG. 8 is a cross sectional view of said carry out tray at line 8—8 of FIG. 7.

The carry out tray 12 shown in FIG. 7 and FIG. 8 is comprised of two cup receiving cells 100 and one sandwich receiving pan 200, integrally connected together by a top rim 101, and by the two central supporting bars 306.

What I claim is:

1. A carry out tray fabricated of resilient material having at least one cell, each cell for receiving at least one cup, each cell having a vertical axis and being comprised of a top rim, a first side wall and a second side wall, two end walls and a supporting bottom panel, each of said two side walls and two end walls being connected to each other at their adjacent edges to form a circumference of said cell, each of said first side wall and two end walls being connected to said bottom panel, whereby to form a supporting structure for said cell, said second side wall being left free of connection to said bottom panel to allow said second sidewall to flex outwardly of said cell when displaced by entry of a cup, thus forming a pressure wall to exert pressure upon said cup between said two side wall, said first side wall being formed with at least two ribs directed downwardly into, and inwardly, of said cell, designed to receive, and provide lateral stability to, said cup located respectively between a pair of said at least two ribs formed on said first side wall and an opposing pair of ribs of said second side wall; said second side wall being formed with at least two ribs directly opposing said at least two ribs of said first side wall, said at least two ribs of said second side wall projecting downwardly into, and inwardly of, said cell to a bottom edge, and at such an angle with said vertical axis of said cell as to project inwardly at said bottom edge into the area to be occupied by said cup, and with a top edge of said second side wall ribs and said second side wall spaced a sufficient distance from a top edge of said first side wall and related ribs to receive said cup, the lower edge of said second side wall being displaced and flexed outwardly of said cell by entry of said cup, thereby producing a supporting pressure upon said cup between said first side wall and said second side wall, with at least a point of contact with said cup at each rib of said opposing pair of ribs of each of said side walls; the areas between the ribs of said second side wall, and between each of two endmost ribs of said second side wall and the adjacent edge of an end wall being tapered from a substantially linear connection to said top rim at their respective top edges to a part cylindrical form at each of their bottom edges, thereby to provide both lateral and outward flexibility across the entire length of said second side wall in order to accommodate the containment of at least one cup.

2. A carry out tray comprised of two of said cells of claim 1, connected together by a top rim extending around the circumference of the space occupied by said two cells together, and by the connection of their respective second side walls to the opposite sides of a centrally located supporting bar.

3. A carry out tray comprised of one cup receiving cell of claim 1 and one sandwich receiving pan integrally connected together by a central supporting bar therebetween and a surrounding top rim, said sandwich pan having at least one supporting leg extending downward from the underside thereof.

4. A carry out tray comprised of two of said cup receiving cells of claim 1 and one sandwich receiving pan therebetween, all integrally connected together by a surrounding top rim and two supporting bars.

* * * * *